US007074009B2

(12) United States Patent
Allmang et al.

(10) Patent No.: US 7,074,009 B2
(45) Date of Patent: Jul. 11, 2006

(54) CASING ASSEMBLY FOR THE TURBINE OF AN EXHAUST TURBOCHANGER

(75) Inventors: Ruediger Allmang, St. Julian (DE); Hartmut Claus, Grunstadt (DE); Volker Simon, Landau (DE)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 10/296,134

(22) PCT Filed: Jun. 6, 2001

(86) PCT No.: PCT/US01/18273

§ 371 (c)(1),
(2), (4) Date: Nov. 21, 2002

(87) PCT Pub. No.: WO01/94754

PCT Pub. Date: Dec. 13, 2001

(65) Prior Publication Data

US 2003/0206798 A1 Nov. 6, 2003

(30) Foreign Application Priority Data

Jun. 7, 2000 (DE) ..... 100 28 160

(51) Int. Cl.
*F01D 25/08* (2006.01)

(52) U.S. Cl. ..... 415/177; 415/205; 415/215.1

(58) Field of Classification Search ..... 415/204, 415/205, 177, 200, 215.1
See application file for complete search history.

(56) References Cited

U.S. PATENT DOCUMENTS 4,253,288 A * 3/1981 Chun ..... 52/454
5,624,229 A * 4/1997 Kotzur et al. ..... 415/204

* cited by examiner

*Primary Examiner*—Edward K. Look
*Assistant Examiner*—Dwayne J White
(74) *Attorney, Agent, or Firm*—Akerman Senterfitt; Stephen A. Pendorf; Greg Dziegielewski

(57) ABSTRACT

A spiral casing for a turbine of a turbocharger is made from thin (0,2 to 2 mm thick) sheet metal. The spiral casing can be made from two matching parts and can be insulated.

11 Claims, 5 Drawing Sheets

CASING ASSEMBLY FOR THE TURBINE OF AN EXHAUST TURBOCHANGER

CROSS REFERENCE TO RELATED APPLICATIONS

This application is a national stage of PCT/US01/18273 filed Jun. 6, 2001 and based upon DE 100 28 160.5 filed Jun. 7, 2000 under the International Convention.

BACKGROUND OF THE INVENTION

1. Field of the Invention

The invention concerns a casing assembly for the turbine of an exhaust turbocharger. The invention especially concerns the spiral casing of the turbine.

2. Discussion of the Related Art

Exhaust turbochargers are a must in modern vehicles. The most important components include a turbine and a compressor. These two components are located on one and the same shaft. The exhaust of the internal combustion engine is conducted to the turbine. The exhaust powers the turbine. Then the turbine in turn powers the compressor. This takes in air from the environment and compresses it. The compressed air is then used for combustion in the engine. The purpose of exhaust turbochargers is to minimize the exhaust emissions as well as to increase the efficiency of the engine and its torque. They also have an important function in regards to the efficiency of the catalytic converter.

The following requirements are generally demanded of an exhaust turbocharger: It should fulfill the mentioned functions regarding the exhaust emission, the efficiency level and torque of the engine in the most optimal manner possible. In doing so., it should have minimal weight and minimal construction volume. The design should be simple and easy to assemble, so that manufacturing costs are held to minimal levels. It should be compatible with catalytic converters.

SUMMARY OF THE INVENTION

The known exhaust turbochargers do not fill all these functions, or only to a certain point. That is, lowering pollutant emissions during the cold start phase leaves much to be desired, and weight and space demands are unreasonably high.

The task of the invention is to design a casing assembly of the type mentioned in such a manner so that improvements in the—parameters mentioned are significant.

In order to do this, in the casing assembly, at least the spiral casing, is made of a relatively thin sheet metal wall which conducts the exhaust flow away. This greatly reduces the weight of the casing assembly. The sheet metal wall only has minimal heat accumulation capacity due to the minimal mass. This means that it accepts only little heat energy from the exhaust, and therefore only removes little heat from the exhaust during the cold start phase.

Based on the invention, the sheet metal wall is surrounded by insulation. This means that the heat remains in the exhaust. Therefore, the exhaust flow reaches the catalytic converter in a very hot condition right from the first starting of the engine. This is an important prerequisite for its smooth operation, so that the emissions already are minimized during the start phase.

The insulation also keeps the outer shell of the affected components relatively cool. This is an important advantage, since the turbocharger can be thus be arranged along with other heat sensitive components, for example with heat sensitive cables. The re-radiation towards the body is also minimized so that the exterior paint remains unharmed. It is understood that the low wall thickness of the sheet metal wall also contributes to the decreased weight.

It is especially convenient to manufacture the insulation from a sheet covering around the sheet metal wall. In doing so, an air gap should remain between the sheet metal wall and the sheet covering, creating an especially good insulation. The sheet covering can be substantially thinner than the sheet metal wall. Yet it provides an excellent heat barrier, since passage from one medium to another—here air to the sheet covering—creates a heat transfer barrier.

The sheet covering also fulfills a further function: It increases the rigidity of the entire design. This can lead to further minimizing the sheet metal wall which is contacted by the gas flow.

BRIEF DESCRIPTION OF THE DRAWINGS

The invention is further explained in the drawing. The following details are represented.

DETAILED DESCRIPTION OF THE INVENTION

Figure 1:
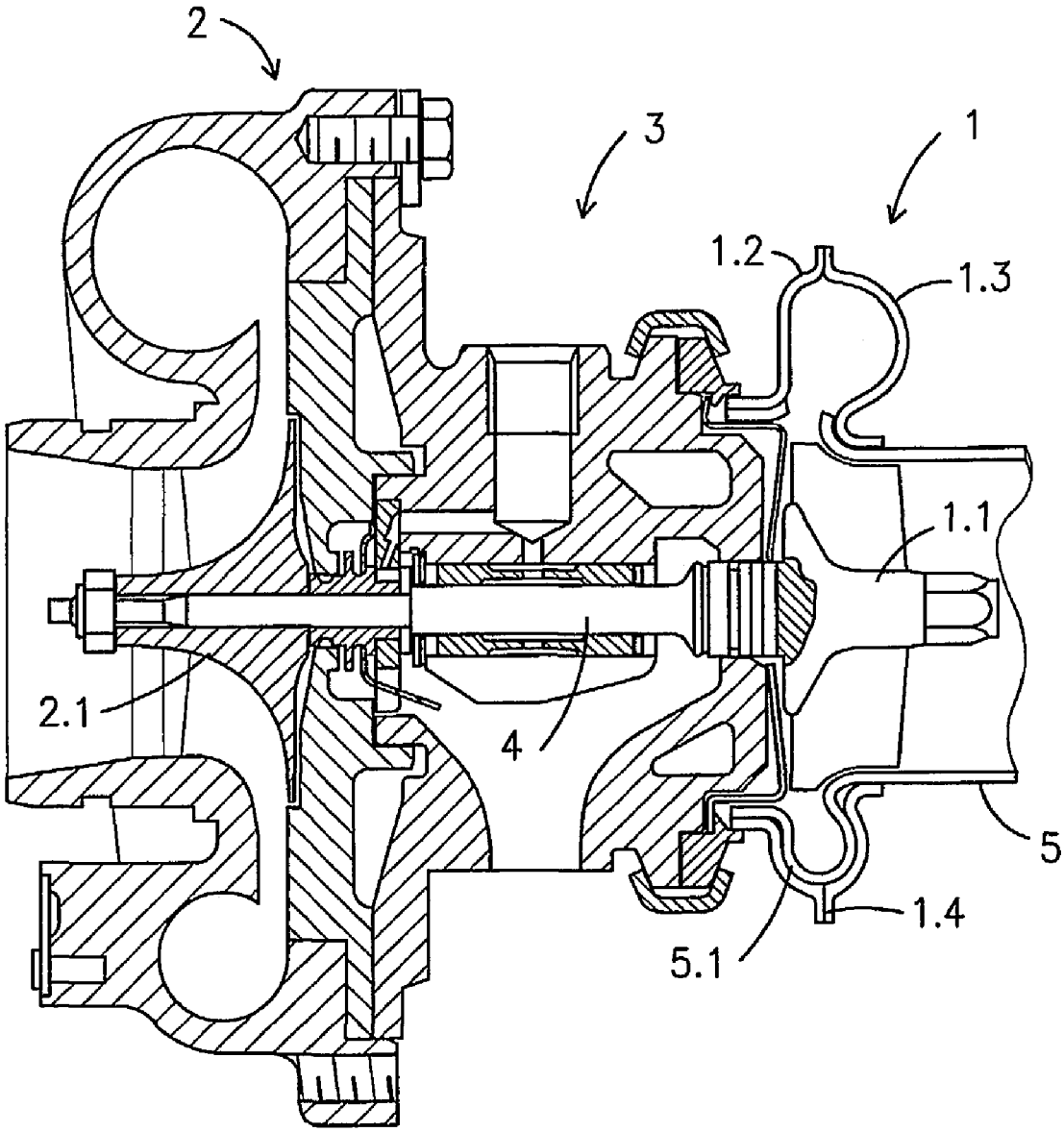
FIG. 1 shows an exhaust turbocharger in axial section.
Figure 2:
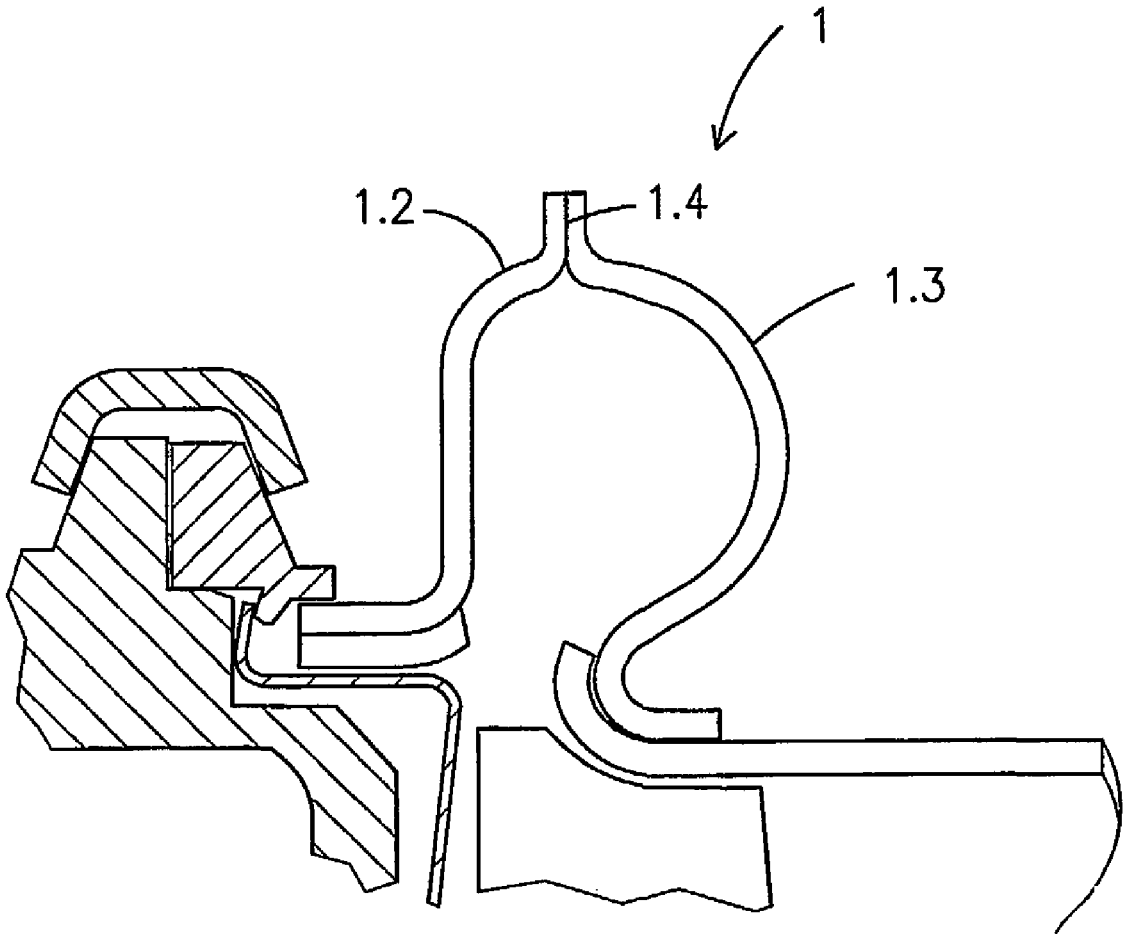
FIG. 2 shows a segment of FIG. I in the area of the turbine casing.

The exhaust turbocharger shown in FIG. I includes a turbine I as the most important component, a compressor 2 as well as a bearing 3. The turbine I has turbine wheel 1. 1 and the compressor has a compressor wheel 2. 1. Both wheels are set on a common shaft 4. The shaft 4 is supported by bearing 3.

The essential feature of the illustrated view is the turbine casing 1. In the present case, it is manufactured from sheet steel. It is usually a spiral casing. It is built from two main parts, namely from an inner component 1.2 and an outer component 1.3. The separation joint 1.4 between these two 3 parts runs along the apex line of the spiral casing 1. There, a welded seam is made.

The wall thickness of both casing parts amount to 1.0 mm. The sheet metal is highly heat resistant (T3>than 1000° C.).

Figure 7:
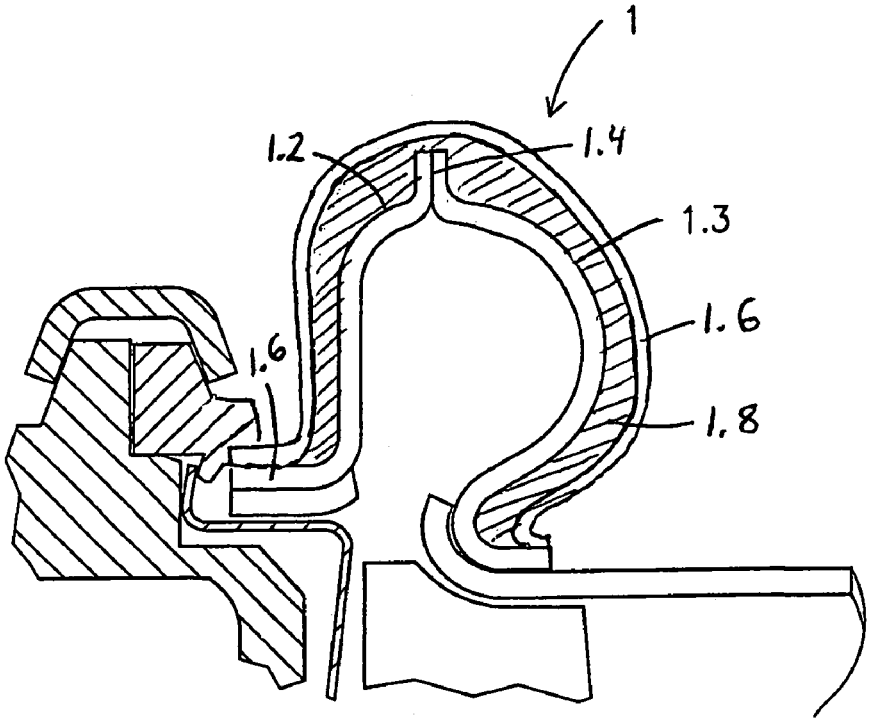
FIG. 7 shows an embodiment of the invention with insulation.

The sheet metal wall is surrounded by an insulation 1.8 as shown in FIG. 7 which is located on the outer skin of the sheet metal, and due to its heat insulating properties, ensures that at this location, namely the outside of the insulation, only very much lowered temperatures exist, for example, temperatures which can still be touched by hand.

In addition, there is an outlet connection 5 to conduct away the exhaust, after it has flowed through turbine I and therefore performed its task. The outlet connection 5 is connected to the casing 1.2,.1.3 of the turbine 1. It has an extension 5.1. This is designed and arranged in such a manner that it covers the highly thermally stressed tongue area of the turbine casing 1.2, 1.3. See also FIG. 5. In doing so, the extension 5.1 in the tongue area is adapted to or conforms to both casing parts 1.2, 1.3. It can welded to these.

Figure 3:
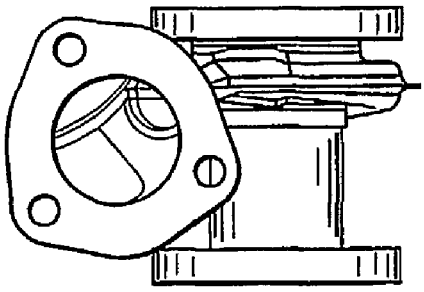
FIG. 3 is a view of the turbine casing, from above, onto the inlet supports.
Figure 4:
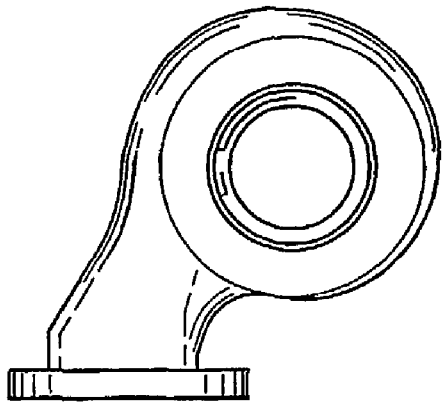
FIG. 4 is a view from above on a half of the turbine casing, also viewed in axial direction.
Figure 5:
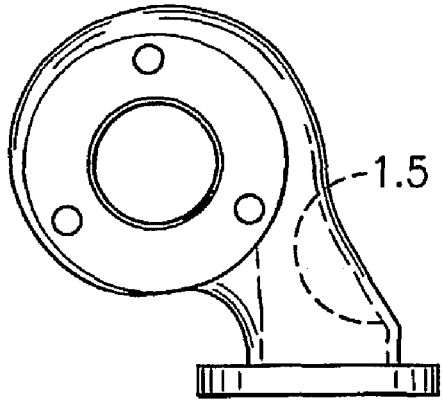
FIG. 5 is a view of the other half of the turbine casing, also viewed in axial direction.

FIGS. 3 to 5 show the sheet steel casing in different views. In FIG. 5, the tongue area 1. 5 can be seen. This area is especially highly thermally stressed.

Figure 6:
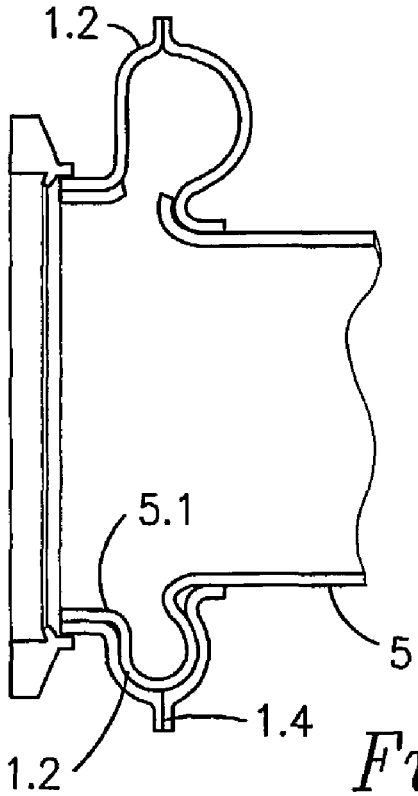
FIG. 6 shows an additional execution type of the invention.
Figure 8:
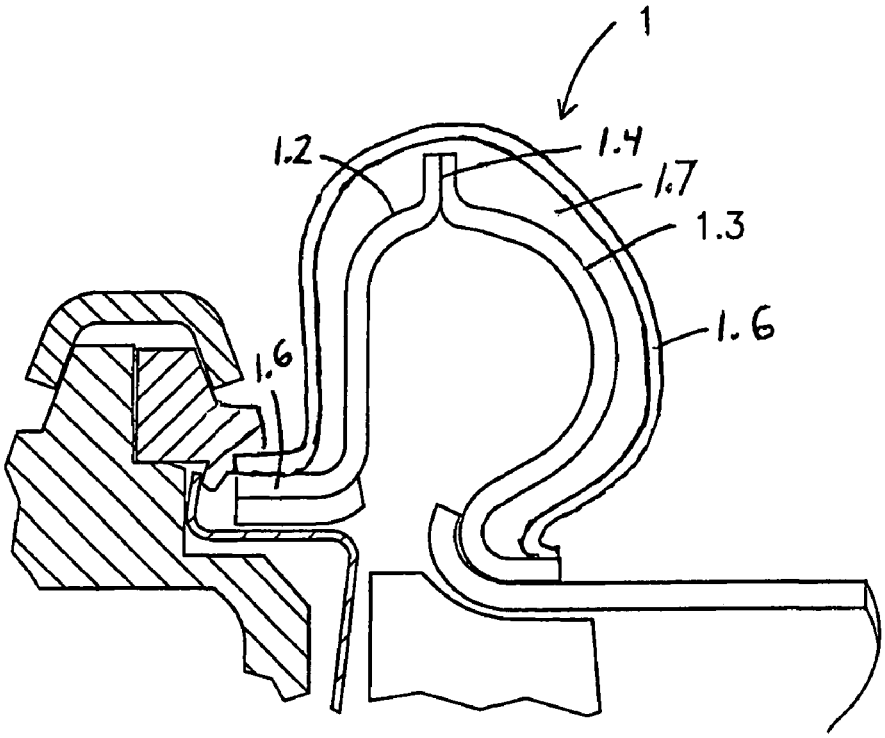
FIG. 8 shows an embodiment of the invention with air gap.

FIG. 6 and FIG. 8 show an especially important execution of the invention. The sheet steel casing for this is again made of two parts 1.2, 1.3. Yet each of these two parts have double walls. The two walls are formed to create an air gap 1.7. The air gap allows especially good insulation. In this embodiment the outlet connection 5 also has an extension 5.1 which covers the tongue area of the spiral casing.

The invention claimed is:

1. A casing assembly for the turbine (1) of an exhaust turbocharger, comprising:

a) a spiral casing (1.2, 1.3) adapted to surround the running wheel (1.1) of a turbine;

b) a tongue-like wall part (1.5) in the inside of the spiral casing;

c) an inlet connection;

d) an outlet connection (5);

e) a flange or sleeve (1.6) to connect the spiral casing to a bearing casing;

f) wherein at least the spiral casing is formed from an exhaust flow conducting sheet metal (1.2, 1.3);

g) wherein the thickness of the sheet metal is between 0.2 and 2 mm; and h) wherein the sheet metal is surrounded by insulation.

2. A casing assembly as in claim 1, wherein the spiral casing is divided along a separation joint.

3. A casing assembly as in claim 2, wherein the separation joint runs along the apex line of the spiral casing.

4. A casing assembly as in claim 1, wherein the insulation is made of a fluid, hardenable mass.

5. A casing assembly as in claim 4, wherein the insulation is applied by dipping in a bath of the mass, or by spraying the mass on the sheet metal.

6. A casing assembly as in claim 1, wherein the insulation is covered by a covering sheet.

7. A casing assembly for the turbine (1) of an exhaust turbocharger, comprising:

a) a spiral casing (1.2, 1.3) adapted to surround the running wheel (1.1) of a turbine;

b) a tongue-like wall part (1.5) in the inside of the spiral casing;

c) an inlet connection;

d) an outlet connection (5);

e) a flange or sleeve (1.6) to connect the spiral casing to a bearing casing;

f) wherein at least the spiral casing is formed from an exhaust flow conducting sheet metal (1.2, 1.3);

g) wherein the thickness of the sheet metal is between 0.2 and 2 mm; and h) wherein the sheet metal is surrounded by insulation (1.8), wherein the insulation is covered by a covering sheet of sheet metal (1.6) having less thickness than the spiral casing sheet metal.

8. A casing assembly for the turbine (1) of an exhaust turbocharger, comprising:

a) a spiral casing (1.2, 1.3) adapted to surround the running wheel (1.1) of a turbine;

b) a tongue-like wall part (1.5) in the inside of the spiral casing;

c) an inlet connection;

d) an outlet connection (5);

e) a flange or sleeve (1.6) to connect the spiral casing to a bearing casing;

f) wherein at least the spiral casing is formed from an exhaust flow conducting sheet metal (1.2, 1.3);

g) wherein the thickness of the sheet metal is between 0.2 and 2 mm; and h) wherein the spiral casing sheet metal is covered by a sheet metal covering sheet (1.6) having less thickness than the spiral casing sheet metal, and wherein an air gap (1.7) is provided between the spiral casing sheet metal and the covering sheet.

9. A casing assembly as in claim 1, wherein the tongue is covered by a covering.

10. A casing assembly as in claim 9, wherein the covering is a sheet metal coating.

11. A casing assembly as in claim 10, wherein the covering is formed as an extension of the outlet connection.

* * * * *